United States Patent [19]

Stahler

[11] 4,217,589

[45] Aug. 12, 1980

[54] GROUND AND/OR FEEDLINE INDEPENDENT RESONANT FEED DEVICE FOR COUPLING ANTENNAS AND THE LIKE

[76] Inventor: Alfred F. Stahler, 5521 Big Oak Dr., San Jose, Calif. 95129

[21] Appl. No.: 928,151

[22] Filed: Jul. 26, 1978

Related U.S. Application Data

[63] Continuation-in-part of Ser. No. 648,377, Jan. 12, 1976, abandoned.

[51] Int. Cl.[2] ..... H01Q 1/50

[52] U.S. Cl. ..... 343/722; 343/792; 343/885

[58] Field of Search ..... 343/790, 791, 792, 822, 343/885, 722, 803

[56] References Cited

U.S. PATENT DOCUMENTS

| | | | |
|---|---|---|---|
| 2,158,875 | 5/1939 | Leeds | 343/853 |
| 2,297,512 | 9/1942 | von Baeyer | 343/791 |
| 2,297,513 | 9/1942 | von Baeyer | 343/791 |
| 2,485,457 | 10/1949 | Potter | 343/791 |
| 2,594,055 | 4/1952 | Miller | 343/792 |
| 3,656,167 | 4/1972 | Lea | 343/822 |

*Primary Examiner*—Eli Lieberman

[57] ABSTRACT

A feed device is tuned to resonance at a selected frequency, to provide essentially infinite impedance between, for example, a system being fed and the power source. The feed device allows passage of feedline currents, which are equal in magnitude and opposite in phase, but prevents passage of any other, unbalanced currents, e.g., common mode currents, antenna radiation currents, etc. This is due to the fact that the infinite impedance of the feed device defines extremely high attenuation to currents other than feedline currents, at the selected frequency. Thus the resonant feed device acts as an isolating circuit for transmitting and receiving antenna systems and the like, since any unbalance in the antenna elements is isolated from the feedlines, and vice versa, whereby the antenna is truly ground and/or feedline independent. When the antenna is located far from a conducting ground two of the resonant devices are required, however only one resonant device is required when the antenna is located in close proximity to a conducting ground.

2 Claims, 22 Drawing Figures

GROUND AND/OR FEEDLINE INDEPENDENT RESONANT FEED DEVICE FOR COUPLING ANTENNAS AND THE LIKE

This is a continuation-in-part of U.S. application Ser. No. 648,377, filed Jan. 12, 1976, now abandoned.

BACKGROUND OF THE INVENTION

1. Field

The invention relates generally to antenna systems, and more particularly to a resonant feed device for coupling a coaxial or parallel wire system in a ground independent and/or feedline independent manner.

2. Prior Art

There are various feed devices for antenna systems, and many integral combinations of feed devices and antenna configurations, available at present which have been designed to improve the radiation characteristics and thus the efficiency of antennas, to physically shorten antennas while retaining their electrical characteristics, to simplify the antenna configurations, to provide improved broadband characteristics, etc. The feed devices employed have proved to be an inherent weak link in the overall system, in that any unbalance in the radiators of the antenna or in the feed lines thereto, cause a corresponding self-destructive increasing cycle of feed line unbalancing, with attendant further increase in the radiator unbalance, etc.

To illustrate, it is commonly known in the art that vertical antennas are generally preferable to horizontal antennas since the former have a much lower radiation angle with respect to the earth, wherein, for example, a transmitting antenna provides a greater range of communication. In addition, a vertical antenna configuration lends itself to mobile installations on moving vehicles as well as a more pleasing appearance in stationary installations in populated areas. However, horizontal antenna configurations have an inherent advantage in that their feed lines drop perpendicularly to the plane of the antenna and thus there is minor interaction between any unbalanced currents in the feed line and the horizontal radiating elements of the antenna.

On the other hand, the feed line coupled to a vertical antenna configuration extends therefrom parallel to the elements thereof, whereby any unbalance currents flowing in the feed line generate a radiation interaction with the antenna, which interferes with the transmission directivity and front-to-back ratio of the radiation pattern. This is particularly true in center fed vertical antennas of any of the various configurations; e.g., dipole, yagi, log periodic, etc. In end fed vertical antennas, the interaction, while not as pronounced, still causes interference with the radiation pattern to greatly reduce the efficiency, i.e., the range of communication of the antenna.

Various schemes have been developed to overcome the difficulties caused by unbalanced radiator elements and/or unbalanced current flows in a feed line, some of which are concerned with the antenna structure itself, and others with the feed line arrangement, configurations, etc.

Typical of antenna structures designed to circumvent the effects of unbalanced currents in the radiating elements are those known as folded dipoles, sleeved or shielded dipoles, etc. Examples of prior art antenna structures which inter alia show the folded sleeved dipole construction are found in U.S. Pat. No. 3,438,042 to J. A. Keucken, U.S. Pat. No. 3,293,646 to H. Brueckmann, and the publication, "Antennas and Transmission Lines," J. A. Keucken, Howard W. Sams & Co., Inc., 1969, cf. Chapter 31, et al.

Other antenna structures employ the integral addition of specific components to electrically alter the antenna, or to provide a feed device, to increase or otherwise match the impedance of the feed line coupled thereto. Such solutions take advantage of the plane of symmetry that exists about the center of a dipole antenna, by making that plane of symmetry ground, and feeding the antenna between the ground and the quarter wave vertical radiator. This supposedly is mathematically the same as having an isolated antenna in free space. The problem is that it is very difficult to obtain an electrically true, absolute ground. Any resistance that occurs becomes a direct loss in the antenna. Thus, impedance matching feed devices which are based on the presumption that the impedance is "high" at the end of the (dipole) antenna, and that the feed line should be transformed from a low impedance to a high impedance to allow efficient feeding of the antenna from its end, are inadequate. The impedance of an antenna at the ends where the antenna current is zero with respect to ground is not definable, since the curl of magnetic and electrostatic fields is not zero. Ergo, the current flow in an antenna can be defined, but the voltage at the antenna end cannot. Therefore, attempts to match the feed line impedance with the "high" impedance of the antenna via diameter relationships, inductors or choke coils, shieldings, etc., are in fact futile, because the addition of the high impedance calculated as that of the antenna is insufficient; the antenna is not fed with respect to ground. It is undesirable to have a current flowing between the end of the antenna and ground. Rather, the antenna should be isolated with respect to ground, i.e., made ground independent. This can only be accomplished by providing a feed device not of matching "high" impedance, but one of overall impedance approaching infinity. It follows that the feed device or devices must be resonant to present an infinite impedance.

Typical of feed devices integral with antenna structures are those shown in the prior art citations of previous mention, as well as in U.S. Pat. Nos. 2,913,722 and 3,100,893 to H. Brueckmann, 2,210,066 to E. C. Cork et al, 2,311,472 to H. O. Roosenstein, and in the United Kingdom Patent Specification No. 690,113 to R. B. Coulson.

Additionally, there are prior art antenna feed devices that employ some form of resonant means, but they all have serious deficiencies that prevent their utilization in practical, efficient antenna structures. Typical of these devices are those depicted in U.S. Pat. Nos. 2,485,457 to R. K. Potter, 3,879,735 to D. V. Campbell, et al, and 2,297,513 to H. J. von Baeyer. These patents, in common, suffer from their incompleteness in presenting a fully operable and practical antenna system. All three use a form of resonant feed device, but none employ a ground connection to their resonant device on the coupling thereto opposite their connection to the antenna. Under these conditions, the feed device, whether resonant or not, becomes only a phase shifting device which couples the rest of the feed line (of undetermined length) to the radiating antenna, drastically changing the resonant frequency and the radiation pattern of the antenna. In addition these prior art resonant feed devices are physically configured to provide resonance using distributed capacitance and/or inductance. Because of this means of establishing resonance it is impossible to accurately determine the location of the current node in the resonant feed device. As a result, the feed device is attached to the antenna at some point other than the current, i.e., electrical, node point, where there is current flow, and the device then interacts with the driven antenna, much like a capacitance hat, thus changing its resonant frequency and its radiation characteristics.

In a further U.S. Pat. No. 2,158,875 to L. M. Leeds, there was suggested the physical arrangement of components for a form of resonant feed device. The latter patent shows that the currents flowing inside a coaxial cable can be very different than those flowing on the outside of the coaxial cable, and that the coaxial cable can be coiled into an inductor, which when resonanted by a shunt capacitor, provides a high impedance between the connection point of the device and the antenna, and ground. However in such device, the frequency of the currents flowing inside of the coaxial cable are not at all related to the frequency of the currents flowing in the antenna structure and in the resonant device, and the device is connected to the (wrong) antenna (i.e., a tower antenna) at a point of well defined impedance, i.e., it is connected in shunt across the output terminals of the transmitter which obviously does not provide infinite impedance.

Typical of another prior art feed device is the balanced-to-unbalanced device, commonly known in the art by the abbreviation "balun," utilized primarily to couple a balanced load to an unbalanced source, i.e., to provide impedance matching over a large range of frequencies. The balun is essentially a transformer whose secondary (to the antenna) is center tapped to ground, and whose primary (to the receiver or transmitter) is connected to a coaxial cable. The shield of the coax is grounded. The balun transformer makes a geometric balanced-to-unbalanced transform, with symmetry about the ground which is common to the primary and secondary windings. The transformer works well when the ground connection is a true RF ground capable of absorbing any unbalanced or circulating currents. It is physically seldom possible, at frequencies less than 50 MHz, to achieve a true RF ground at the feed point of an antenna. Therefore, any unbalanced current in the supposedly balanced load will be directly reflected in the primary current and will result in current flow in the coax shield. Since, in reality, the dipole antenna is seldom perfectly balanced due to asymmetry in the world surrounding the antenna, e.g., trees, buildings, etc., the resulting initial unbalance will cause an increased unbalance due to the interaction of the radiated feed line or coaxial shield currents and the radiated antenna currents. Thus, the balun transformer only works when the secondary load is truly balanced, is non-radiating, or in the special case where the coaxial shield feeding the balun represents a true absolute ground. However, as mentioned above, true absolute grounds are almost impossible to obtain practically, particularly for mobile installations. Furthermore, if a true absolute ground is available at the coaxial shield connection to the antenna, then there is no need for the balun since no interfering radiation is generated in the first place.

SUMMARY OF THE INVENTION

The resonant feed device overcomes all the shortcomings of the above-mentioned common, as well as specialized, horizontal and/or vertical antenna configurations, and of the balun or other specific choke type, etc., feed devices for use with antenna systems. Thus, the invention comprises means for coupling a receiving or a transmitting antenna system to a receiver or transmitter, respectively, in a ground and/or feed line independent manner. That is, the feed device eliminates unbalanced currents, such as common mode currents, in the feed line. In addition, the device may be employed not only with the radiating (antenna) systems, but also with non-radiating systems such as inter-stage (amplifier) connections. It is noted that the resonant feed device is not a broadband device, but is operable at a single selected resonant frequency.

To this end the proposed feed device can be appropriately configured to provide a selected embodiment for the particular antenna configuration. When the antenna is fed by coaxial cable, the resonant feed device is constructed from the coaxial cable by forming the cable into a coil and shunt connecting an appropriate capacitor to the shield of the coaxial cable at the extremities of the coil. When the antenna is fed by balanced line, parallel conductors, the resonant feed device is constructed by bifilar winding the two conductors into a coil and connecting respective appropriate resonanting capacitors in shunt across the extremities of the coils. The resonant feed device consists of either one such resonant circuit or two such resonant circuits in series, spaced one-quarter of a wavelength apart. (The quarter wavelength is the electrical length measured on the outside of the shield of a coaxial transmission line or the electrical length of a common mode current in the case of the parallel conductor transmission line device.) The current and voltage conditions that exist on the radiating antenna at the point of connection of the feed devices determines whether one or two devices is required. Thus when the feed device is connected at a current node of the antenna, two resonant feed devices are required. When the feed device is connected at a voltage node of the antenna, only one resonant feed device is required. In the configuration wherein a vertical antenna is located close to a conducting ground with the feed device connected at the current node of the antenna close to the ground, only one resonant feed device is required.

DESCRIPTION OF THE PREFERRED EMBODIMENTS

Figure 1:
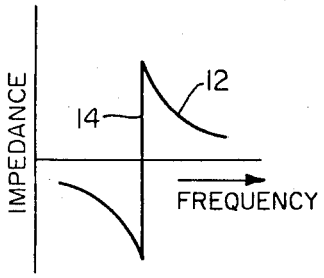
FIG. 1 is a graph depicting the impedance across a shunt connected coil and capacitor as a function of frequency.

In FIG. 1 as the frequency across a shunt connected coil and capacitor is increased towards the resonant frequency of the circuit, the impedance is inductive and increases with frequency. At resonance this impedance becomes very high, theoretically infinite, whereupon at resonance this impedance suddenly shifts to a very high capacitive impedance. At this resonance point, there is a 180° phase shift of the voltages and currents across the resonant circuit. The data of FIG. 1 is representative of the characteristics of the proposed resonant feed devices.

Prior art devices and associated antenna configurations only provide on the order of several hundred through a thousand ohms to ground, which provides an inefficient as well as ineffective antenna configuration as noted above and further described infra. In order for the device to be an efficient antenna, there should be no current flow from the end thereof to ground; ergo, there should be infinite impedance to ground. That is, any impedance will warp the antenna radiation pattern towards this impedance, which in the case of a vertical antenna, would be towards the ground, nullifying the antenna's effectiveness as a radiator used for communication.

Figure 2:
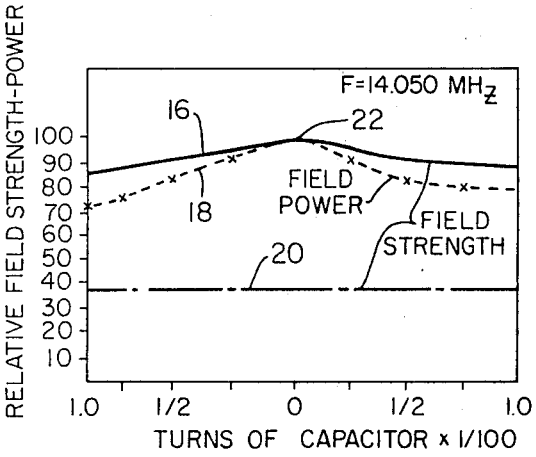
FIG. 2 is a graph of the relative field strength and power output taken in tests of a horizontal dipole antenna with, and without, the resonant feed device.
Figure 14:
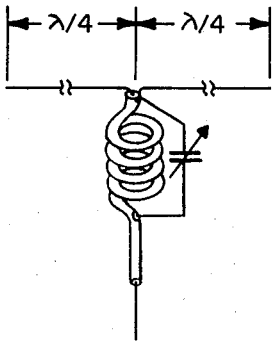
FIG. 14 is a simplified representation depicting the resonant feed device being used to perform an unbalanced coaxial feed line-to-balanced dipole feed point transformation that is normally associated with a balun transformer, wherein the feed device is attached at the antenna voltage node point so that only one device is required.

In FIG. 2, the curves 16, 18 and 20 depict the results of tests taken with a horizontal dipole antenna with and without the integral combination of the resonant feed device of the invention, as fed by a transmitter. The dipole antenna was fed by the coaxial cable and resonant feed device as shown in FIG. 14. The data was taken utilizing a gear-driven variable capacitor disposed across the coil formed of the coaxial line, with the capacitor coupled to the shield of the coax. Thus the data was taken in terms of the degree of rotation of the capacitor versus the relative field strength and power of the antenna during the transmission process. In curves 16 and 18, the setting on the capacitor was selected such that "zero" turns thereof corresponded to resonance of the tuned circuit. At the resonance, the curves 16 and 18 generate 100% relative field strength and power, which occurred for the given antenna and tuned circuit combination at 14.050 MHz frequency. As shown in the curves, as the capacitor was tuned away from resonance (e.g., for one turn of the capacitor apparatus) toward greater capacitance on the one side, and greater inductance on the other, the relative field strength and power radiated by the antenna decreases from 100% to lower relative "efficiencies" of the order of 70–90%.

To provide a comparison between the invention antenna/resonant feed device combination, the resonant feed device was removed from the antenna, and the latter was then conventionally coupled to the transmitter via the coaxial cable either directly or through a 1:1 balun transformer. The shield of the coax was grounded at ground level. The resulting curve 20 is indicative of the relative field strength of such a prior art antenna, wherein the field strength is essentially constant at approximately 36%. There was no appreciable difference between tests with and without the balun. It may be seen that the combination of the invention provides greatly improved relative radiated field strength or power, particularly at the point of resonance of the feed device, i.e., at point 22 of the curves 16, 18.

Figure 3:
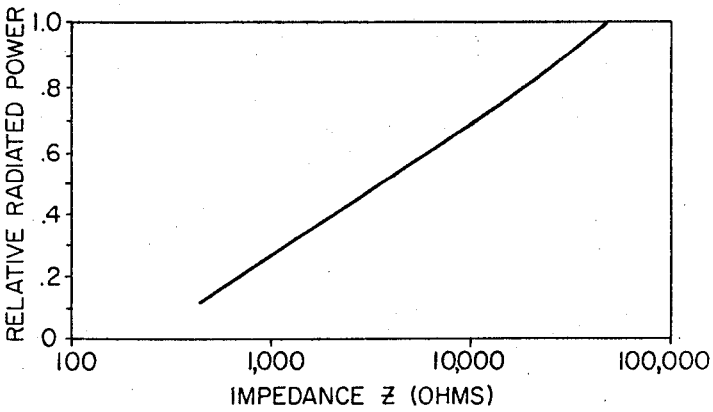
FIG. 3 is a graph of the relative radiated power versus the actual impedance of the resonant feed device for a vertical antenna, wherein the curve is calculated from the measured change in capacitance of the resonant device similar to the data corresponding to the curve of FIG. 2.
Figure 5A:
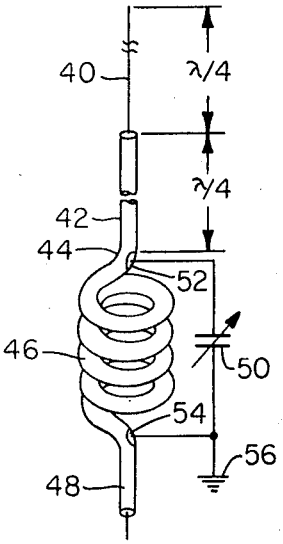
FIGS. 5A, 5B and 6 are simplified perspective views of coaxial vertical dipole antennas, and one which is shortened in length, respectively, in integral combination with the resonant feed device of the invention.

FIG. 3 is a calculation of data points taken during similar experimental tests of a vertical antenna, FIG. 5A, operated with the above-mentioned coaxial coil and gear driven capacitor and raw data taken as in FIG. 2, wherein relative radiated power is plotted against the actual impedance of the coil/capacitor combination at the end of the antenna. The curve indicates that the radiated power of an antenna will decrease for (any) impedance seen at the end of the antenna to ground. As may be seen, at 100% relative radiated power, the impedance of the antenna tested in FIG. 2 is of the order of 50,000 ohms as it approaches infinity. At approximately 800–1000 ohms, which is the impedance added via most of the prior art antenna configurations and feed devices, the relative radiated power is of the order of 10–20%. The difference is efficiency between the prior art devices and the invention combination is readily apparent.

Figure 4:
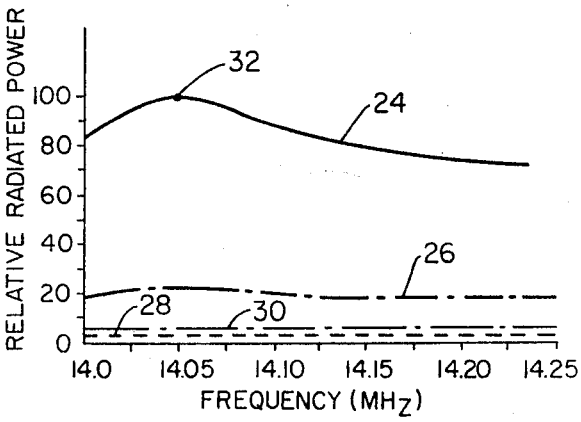
FIG. 4 is a graph of the relative radiated power generated by typical prior art antenna/feed device configurations, compared to the relative radiated power generated by a vertical antenna in combination with the resonant feed device of the invention.

FIG. 4 shows data curves 24, 26, 28 and 30 which compare the relative outputs of a vertical antenna/resonant feed device of the invention combination with various types of prior art antenna configurations; e.g., wherein the latter employ maximum capacitance feed devices, minimum capacitance feed devices and a shortened coil antenna configuration. The curve 24 depicts 100% relative radiated power (point 32) at the resonant frequency of 14.050 MHz. The curve decreases to the order of 80% at lower and higher frequencies, but still maintains a relatively high efficiency within the range of frequencies taken during the test.

By comparison, the data of curves 26, 28 and 30 show low, but relatively constant values. Curves 26 and 28 show the coaxial coil combination with the variable capacitor at its maximum (26) and minimum (28) values. The impedance of the coil/capacitor combination in either case is high, compared to hundreds of ohms, but the resulting efficiency is low; reference FIG. 3. The data of curve 30, minimum capacitance, is representative of the performance of an inductive reactance similar to that described in the prior art, and, as also described in the prior art, its performance does not vary with frequency, i.e., it is broadband. Curve 30 shows the data with the coil/capacitor combination shorted. The increased efficiency is indicative of the relatively high impedance to ground (capacitance in this case) that can exist on the shield of the coaxial cable used to feed the antenna.

It is to be understood, that besides operating at resonance it is desirable to provide a resonant feed device configuration which optimizes the Q thereof to minimize resistive losses. For example, Q is deteriorated by the use of highly permeable materials (which are lossy at R.F. frequencies) for coil winding structures, by small diameter coil wire, lossy dielectric material for the resonating capacitor, high resistance coil wire (at the operating frequency), use of connectors rather than continuous conductors, etc. Since the resistive losses are primarily associated with the inductor winding, high values of Q are usually obtained by use of resonant circuits with a low ratio of the values of the inductance and capacitance.

Figure 15A:
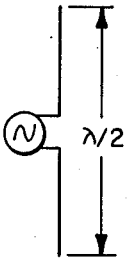
FIGS. 15A, B, C and D are schematic representations of a center fed dipole and its current and voltage distribution, a center fed dipole with shunt resonant devices attached to the current node point of an antenna in accordance with the invention, and the resulting voltage and current distributions of the device of FIG. 15C.
Figure 15B:
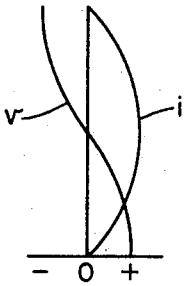
Figure 15C:
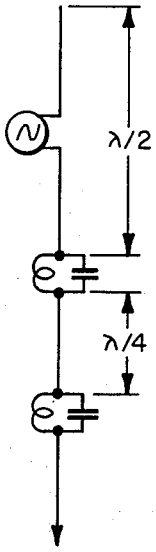
Figure 15D:
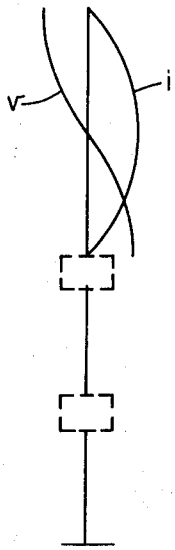

To digress for a moment, FIGS. 15A, B, C and D depict a dipole antenna, center feed, located in free space, i.e., far removed from a conducting ground. FIG. 15A shows the half-wavelength long dipole antenna with its power source connected at its center. FIG. 15B shows the current and voltage distribution that is associated with the dipole antenna of FIG. 15A. FIG. 15C shows the same dipole antenna with a resonant circuit (representative of the instant feed device) connected at the current node of one end of the antenna, with an additional resonant feed device connected a distance of one-quarter of a wavelength from the first device. A conductor of arbitrary length is connected to the other side of the second resonant device and extends to the utilization apparatus. FIG. 15D shows the resulting current and voltage distribution for this modified feed device/antenna configuration. Note that these characteristics are identical to those of the isolated dipole, FIGS. 15A and B. This effect is the result of the combined effects of the two resonant feed circuits, which together comprise the resonant feed device of the invention. The feed device furthest from the antenna is located one-quarter of a wavelength from the current node of the antenna, which on the feed line corresponds to a voltage node or a current maximum point. The high, near infinite, impedance of the resonant circuit will choke or restrict this high current to a very low, near zero value. Since the current can only decrease between the resonant circuit furthest from the antenna and the resonant circuit connected to the current node point of the antenna, then the current on the conductor between these two points must be very low at all places, i.e., approaching zero. At the resonant circuit connected to the antenna at its current node point, the antenna current is zero, and even though the impedance of the resonant device is very high, approaching infinity, it cannot change this current by choking action, i.e., zero is still zero. However, the very high, near infinite impedance of the resonant circuit allows the high antenna voltage that corresponds to the antenna current node to exist on one side of the resonant device while there is zero voltage on the other side of the resonant device.

If the resonant device that is one-quarter of a wavelength from the device at the antenna current node point were not present, the current in the conductor connected to the first resonant device would increase with distance from the antenna, reaching a maximum one-quarter of a wavelength from the antenna current node point. Any current flowing on this conductor will cause radiation which will interact with the dipole radiation and will alter the net radiation characteristics of the antenna.

Figures 16A, 16B, 16C:
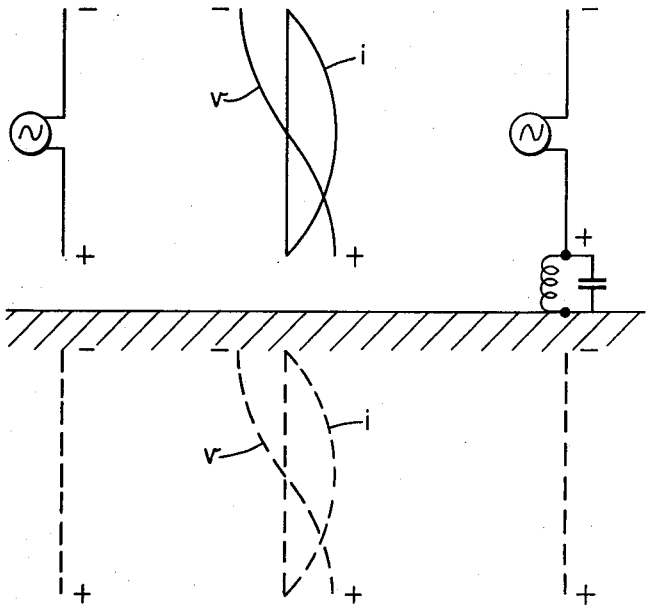
FIGS. 16A, B and C are schematic representations of dipole antennas and their resulting current and voltage distributions when the antenna (either horizontal or vertical) is operated to close to a conducting ground, where herein only one resonant feed device is required.

FIG. 16A shows a center fed dipole antenna similar to the dipole of FIG. 15A, but located close to a conducting ground. In this case the charge distribution on the antenna induces opposite charges on an "image" antenna in the conductive ground. FIG. 16B shows the current and voltage distributions that exist on this antenna and its image. The polarity of the current and voltage in the image antenna are such that the far field radiation pattern is that of a two-element co-linear array, which yields gain over an isolated dipole antenna. FIG. 16C shows a resonant circuit connected between the end, or current node, of the dipole antenna and ground. Because of the very high, near infinite, impedance of the resonant circuit, the current and voltage distributions on this antenna are identical to those of the dipole of FIG. 16A and are also shown in FIG. 16B. The 180° phase shift that occurs in the resonant device is compatible with the 180° phase shift that is induced by the dipole of FIG. 16A into its image antenna. The dipole of FIG. 16A has no connections between its end, current node, and ground so there is no possibility of current flowing into the ground. Similarly, the very high, near infinite, impedance of the resonant device of FIG. 16C prevents any current from flowing from the antenna to ground.

FIG. 16C depicts a modification of the embodiments of FIGS. 15 that is possible when the antenna is located close to a conducting ground. However, the embodiments of FIG. 15 are equally suitable to feed an antenna located near a conducting ground.

Referring to FIG. 5A, a vertical antenna structure is formed of a coaxial cable, of the type known as RG-58U. This antenna is located near a conducting ground so that, as described above, only one resonant feed device is required. If it were located far from ground two resonant feed devices spaced one-quarter of a wavelength apart would be required. This single device configuration is selected at this point to provide an opportunity to accurately describe the constructional details of the instant resonant feed device, which is typical for the invention in the form of one or two devices. To this end, the center conductor extends from the center of the antenna a length equal to $\lambda/4$ ($\lambda$ being the wavelength of the radiated signal) to define an upper radiator 40. The antenna lower radiator 42 is defined by the outer conductor, or shield, of the coaxial cable, with a similar length of λ/4. At the point corresponding to a "base" 44 (corresponding to the antenna's electrical node point) of the resulting ½λ wavelength, vertical antenna, the coaxial cable forming the antenna radiators and the feed line is wound into a coil 46 of selected diameter and number of turns. The lower end of the cable is coupled to a utilization apparatus (not shown) such as a transmitter in the case of a transmitting antenna, or a receiver as when employing a receiving antenna, via a feed line 48, which is a continuation of the coaxial cable forming the coil 46. Thus, the antenna is end-fed by the transmitter.

In accordance with the invention combination, a capacitor 50 is coupled across the coil 46 formed of the coaxial cable, with the coupling being made to the shield of the coax (as at points 52, 54) to define thereby a tuned circuit. Note that the capacitor 50 is not coupled to the inner conductor of the cable. In the embodiment of FIG. 5A, the coaxial shield must be grounded as at 56. The capacitor 50 is herein shown as a variable capacitor to allow tuning the tuned circuit to resonance at a given preselectable frequency, to thus define the resonant feed device in integral combination with the vertical dipole antenna. A production model of the device would employ a fixed capacitor of computed capacitance commensurate with the antenna configuration in order to provide the resonant feed circuit.

It is to be understood that the capacitor 50 and the inductor coil 46 shown are typical "lumped" capacitive and inductive elements. The term "lumped" implies that each of the two components is essentially a pure element, i.e., the inductor has very little distributed capacitance, and the capacitor has very little distributed inductance. The junction points of the lumped capacitor 50 and inductor 46 are the current node points of the resonant circuit and are thus "well defined," i.e., precisely located at this physical junction point. Although there will be circulating currents in the shunt resonant device, at these two node points the currents to and from the capacitor and inductor will be 180° out of phase, thereby defining a current node point. It is this current node point of the resonant feed device that is coupled to the current node point that exists at the end of the dipole antenna. Connecting two circuits together at their current node points generates no change in the electrical characteristics of either device. Had the antenna been connected to the resonant feed device at some other point thereon, i.e., somewhere along the inductor, it would be connected to a point on the device where current is flowing. This situation occurs when resonance is achieved through the effects of distributed capacitive and/or inductive elements. This situation allows current to flow at the end of the antenna up to the location of the current node point of the shunt resonant feed device. This additional path length for current flow in the antenna effectively lengthens the electrical length of the dipole half which is connected to the feed device. In other words, if the end of the antenna is not connected to the current node point of the feed device, the feed device will act as a "capacitance hat" and it will alter the resonant frequency and radiation characteristics of the dipole antenna. Prior art feed devices such as those of U.S. Pat. Nos. 2,297,513, 2,485,457, and 3,879,735, of previous mention, are typical of such devices known to employ distributed capacitive and/or inductive effects, and thus to exhibit this "capacitance hat" effect.

In FIG. 5A, the coaxial shield is shown grounded at 56. However, if the antenna is not located near a conducting ground, then two resonant feed devices, spaced one-quarter of a wavelength apart, are required, as shown in the discussion supra of FIGS. 15A, B, C, and D. However, with the antenna located close to a conducting ground one may also use the two resonant feed devices of previous mention spaced one-quarter of a wavelength apart. The feed line from the resonant feed circuit attached to the antenna current node may be extended on top of the ground plane, or in any direction for a quarter wavelength over to the second resonant feed circuit, to define the overall resonant feed device. Since there is no current or voltage flowing on the outside of this coaxial cable, its orientation has no effect on the performance of the dipole antenna. With the dual resonant feed device installed, the ground connection 56 may or may not be used. The use of the dual resonant feed device is preferable if the conducting ground is lossy.

As may be seen, the inner conductor of the feed line is employed as the upper radiator 40 of the antenna, while the outside of the outer conductor of the feed line becomes the lower radiator 42. Thus simultaneous currents are generated in the shield portion of the antenna; feed line currents as well as antenna currents. The feed line currents are contained inside the coaxial cable whereby they are unattenuated by the resonant feed device, which is for currents on the outside of the shield of the coaxial cable, and thus the feed line currents are allowed to pass to the radiators 40, 42. However, currents on the outside of the shield, such as common mode currents, antenna radiation currents, etc., are heavily attenuated and are isolated from the antenna. Thus the resonant feed device of the invention is a means for feeding an antenna, or like system that is feed line and ground independent when the antenna is located far from a conducting ground, and feed line independent and ground compatible when the antenna is located near a conducting ground.

Figure 5B:
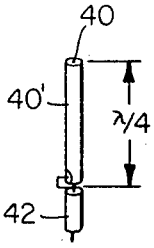

As shown in FIG. 5B, the upper radiator (40) may be formed by utilizing the entire coaxial cable structure and soldering the inner conductor to the shield and severing the shield at the center of the antenna. Thus the upper radiator 40' is then a one-quarter wavelength of coaxial cable shield, as is the lower radiator 42. It is commonly known that the characteristics of an antenna change with wire diameter, whereby the configuration of FIG. 5B provides upper and lower radiators which are identical and symmetrical about the center of the antenna. Such a symmetrical configuration can also be employed with any of the coaxial cable antennas infra.

Figure 6:
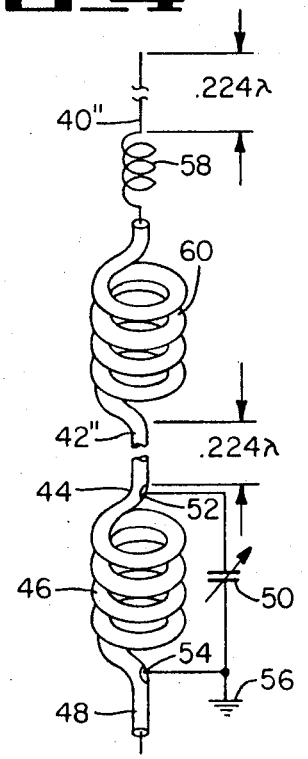

FIG. 6 depicts a physically shortened, vertical antenna coupled with the resonant feed device of the invention, wherein loading coils 58, 60 are inserted at the center of the antenna. The shortened antenna is similar to the one-half wavelength antenna of FIG. 5, wherein the shorter radiator lengths (e.g., equal to 0.224λ) are compensated for by the insertion of the coils 58, 60 to provide an upper radiator 40'' and a lower radiator 42'' with the same (i.e., λ/4) electrical lengths as in FIG. 5. In this case, the shortened antenna has a radiation resistance of 50 ohms, which provides a perfect impedance match to the RG-58U coaxial cable when the antenna is operated at its resonant frequency. The tuned circuit of the resonant feed device in FIG. 6 is the same as that of FIG. 5, and like components thereof are similarly numbered. Thus the antenna/feed device of FIG. 6 is a physically shortened, but electrically identical, version of FIG. 5. If this antenna were to be operated far from a conducting ground, then the dual resonant feed device with one-quarter wavelength spacing would be required.

Figure 7:
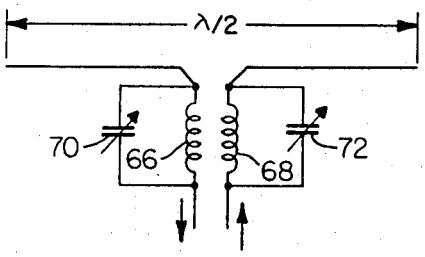
FIGS. 7 and 8 are simplified schematic diagrams of twin line horizontal and vertical antennas, respectively, in integral combination with the resonant feed device of the invention, wherein the resonant feed device is located at a voltage node of the antenna and only one device is required.

FIG. 7 depicts the integral combination of the resonant feed device with a horizontal one-half wavelength antenna configuration. The feed line is formed of open or twin lines wires rather than of a coaxial cable. Thus, radiators 62, 64 are formed of separate wires, which are wound into respective coils 66, 68. The free ends thereof couple to the feed line. A pair of capacitors 70, 72 are coupled across respective coils 66, 68 to form a pair of tuned circuits, one for each conductor. The coils 66, 68 are bifilar wound about a common core (FIG. 8) whereby they have very high mutual inductance therebetween. Since the coils are identical, and the feed line currents therethrough are identical but in opposite phase, the currents set up inductive fields which cancel each other. Thus, the tuned circuits look like direct shorts to the feed line currents. However, common mode currents do not cancel, and the resonant feed device provides an infinite impedance to the latter, thereby preventing unbalanced currents from passing to or from the antenna. In this case the resonant feed device is connected to the antenna at an antenna voltage node point and only one resonant feed device is required.

Figure 8:
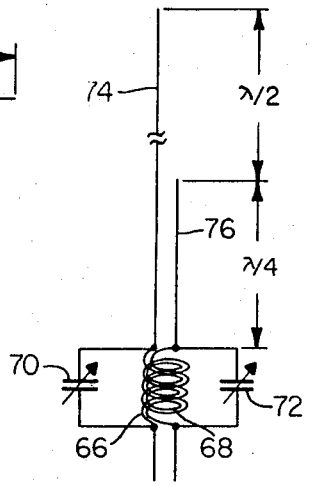

FIG. 8 illustrates a vertical twin line antenna configuration integral with the pair of tuned resonant feed circuits similar to those shown in FIG. 7. The coils 66, 68 are bifilar wound about a common core, with the capacitors 70, 72 coupled across respective coils. The upper and lower radiators 74, 76 respectively are of one-half and one-quarter wavelength, thereby producing a voltage node point at their common ends. Since the resonant feed device is connected at this antenna voltage node point, only one resonant feed circuit, i.e., device, is required.

Figure 9:
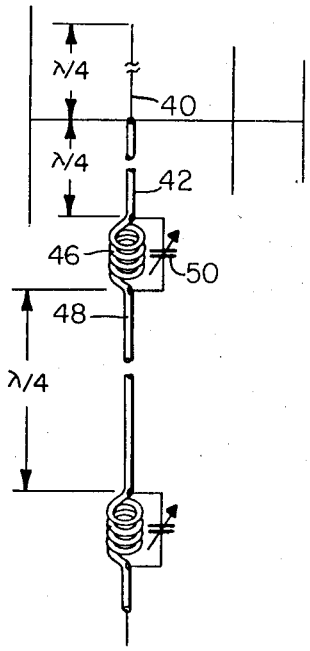
FIGS. 9 and 10 are simplified schematic diagrams of yagi and multi-band vertical dipole antennas, respectively, in integral combination with the resonant feed device of the invention, wherein in FIG. 9 it is customary to locate yagi antennas high, and thus far from a conducting ground, whereby two resonant feed devices are used.

FIG. 9 depicts the resonant field device of the invention coupled to a vertical yagi antenna array, wherein the conventional driven element thereof is replaced by the vertical antenna configuration of FIG. 5A, including an integral resonant feed device. Like components are similarly numbered. Vertical yagi antennas provide a preferred radiation pattern compared to horizontal, however, the former are extremely difficult to drive efficiently since any unbalanced currents in the feed lines or radiators cause the generation of further unbalance and resulting deterioration of the antenna radiation characteristics. Use of the resonant feed device, however, provides a ground and feed line independent relationship whereby a vertical yagi may be efficiently coupled to a utilization apparatus. That is, the resonant feed device minimizes the induced feed line currents and their detrimental effects on the antenna gain and front-to-back ratios.

Directional antennas, such as a yagi, are usually located as far above ground as possible with the antenna structure located far from a conducting ground, the dual resonant feed device, with one-quarter wavelength spacing, is required.

Obviously, the resonant feed device can also be utilized with log-periodic, or other parasitic, antenna arrays in the same manner as described relative to the yagi array of FIG. 9.

Figure 10:
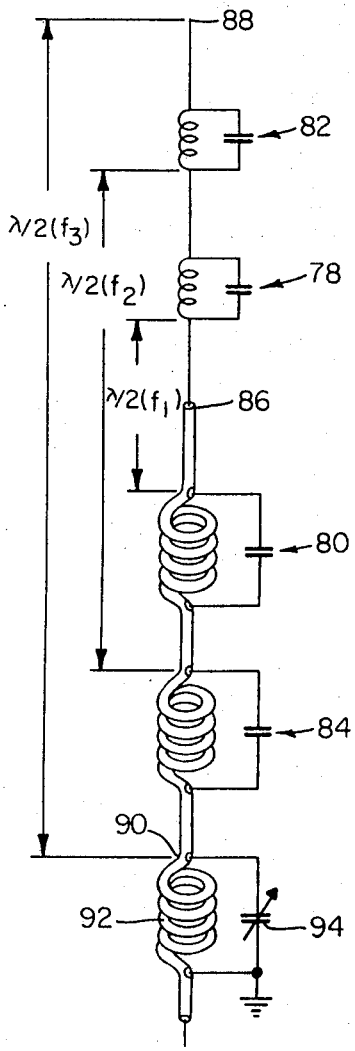

FIG. 10 depicts the integral combination of the resonant feed device and a multiple-band vertical antenna configuration, which is thus capable of handling a plurality of frequencies. The antenna generally is of conventional design, and is herein shown, by way of example, with matching pairs of (resonant) traps 78, 90 and 82, 84 about the center 86 thereof, to provide thus a three-band vertical antenna array. The traps 78, 80 are conventionally disposed one-half wavelength apart, the traps 82, 84 are one-quarter wavelength from traps 78, 80 respectively, with the end 88 and base 90 of the antenna terminating one-quarter wavelength from traps 82, 84 respectively. The traps comprise an inductor and capacitor which are resonant at the desired frequencies $f_1$ and $f_2$.

In accordance with the invention, the coaxial cable forming the antenna is extended from the base 90 thereof and is wound in a coil 92 of the resonant feed device. A capacitor 94 (preferably variable) is coupled across the coil 92, to the shield of the coax. The resonant feed device resonates at a frequency $f_3$. The traps 78–84 are employed in conventional fashion, to isolate one section of the antenna length from another section, at the given frequencies of resonance thereof. The resonant feed device, on the other hand, is used to feed the antenna in a ground and/or feed line independent manner.

The operation of this multi-band trap vertical antenna with coaxial-resonant end feed is best described by starting at the highest resonant frequency, $f_1$. Here the trap at the upper end of the antenna serves to electrically isolate the high frequency half wave from the rest of the antenna above it. The resonant trap on the coaxial feed or lower side of the antenna acts as a resonant coaxial feed device as previously described for the antenna of FIG. 5A. The feed line currents are unaffected as they pass through the two trap resonators on their way up to the upper resonator.

At the next lower frequency $f_2$, the coil/capacitor combination that provided resonance at $f_1$ now appears as an inductive reactance which is used in combination with physical length to determine the resonant frequency of this section of the antenna. Here, as before, the $f_2$ resonant coil/capacitor combination is used to isolate the active portion of the antenna, either from the rest of the antenna, or from the feed line. At the lowest frequency $f_3$, only one resonant coil/capacitor combination is required because only the feed line need be isolated from the antenna system.

Figure 11:
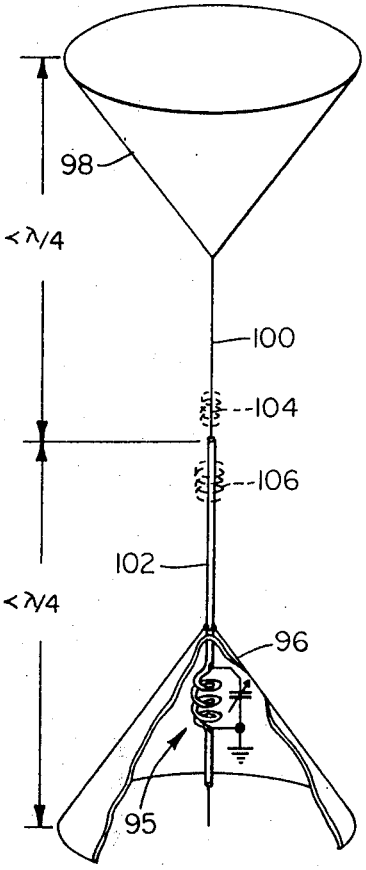
FIG. 11 is a simplified perspective of another embodiment of the invention combination, depicting the use of a "capacitance hat" to shorten, or otherwise improve the antenna configuration.

FIG. 11 illustrates yet another embodiment of the invention combination, wherein a resonant feed device 95 is tucked under a "capacitance hat" 96 formed, for example, by a conical member of aluminum, etc., material. A capacitance hat 98 may also be disposed at the top of the antenna, whereby the length of both the upper and lower radiators 100, 102 may be physically shortened, while providing the same electrical $\lambda/4$ lengths. In addition, further physical shortening may be provided by inserting loading coils 104, 106 (shown in phantom line) at the center of the vertical antenna configuration, as previously depicted in FIG. 6. The hat 96 minimizes the loss effects due to the finite impedance at resonance by coupling the feed to a point on the antenna physically close to the center of the antenna, while also providing weather shielding for the resonant feed device. Various geometrical shapes may be used to define the capacitance hat, e.g., cylindrical, crossbar, radially extending guys, etc.; the shape is not limited to conical.

The capacitance hat may be increased in length to extend to the center of the antenna, whereby the tuned circuit of the resonant feed device is also positioned very close to the center. This decreases the detrimental power loss due to a finite impedance at resonance. The antenna is essentially being center fed, ergo, approaches the design of a sleeve dipole, center fed by a resonant feed device. Tucking the resonant feed device up under the extended cone, in essence, shifts the point of electrical ground up, whereby if the impedance has finite components, not infinite, they are shifted towards the center of the antenna which is much less sensitive to the impedance. The antenna shown in FIG. 11 is located close to a conducting ground. If it is located far from a conducting ground, or if the ground is lossy, the dual resonant feed device with one-quarter wavelength spacing is used.

Figure 12:
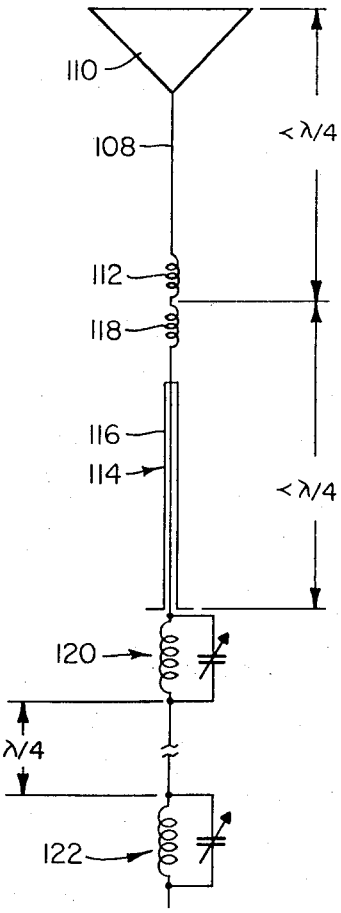
FIG. 12 is a simplified schematic diagram of a further embodiment of a vertical sleeve antenna in combination with a pair of resonant feed devices wherein the resonant feed device connected to the end of the sleeve insures the achievement of very high impedance at this point which is often not practical with reasonable sleeve geometries.

Accordingly, FIG. 12 depicts an antenna array employing some of the features of previous mention, to provide an improved, physically shortened, sleeve dipole in accordance with the invention combination. The upper radiator 108 includes a capacitance hat 110 and a loading coil 112, whereby the length is less than $\lambda/4$. The lower radiator 114 comprises a capacitance hat extending to the antenna center in the form of a sleeve 116 and including a loading coil 118, and whose physical length also is less than $\lambda/4$. A resonant feed device 120 is formed in the end of the coax which extends from the sleeve 116, as previously taught supra.

The sleeve 114, which in effect is a length of coaxial line, can act as a high impedance device, creating a high impedance between the end of the antenna and the feed line extending from the sleeve. This is the principal of the sleeve dipole. The magnitude of this high impedance is, however, a function of the length of the sleeve section and the ratio of the inner to outer diameter of the sleeve. Only high impedances are generally impractical. However, a resonant feed device can be attached to the feed line where it exits the sleeve, which will create a very high impedance at that point, independent of the sleeve geometry and thereby increase the effectiveness of a sleeve dipole.

Additionally as previously described, ground independence is provided by the invention combination, by adding the second resonant feed circuit, i.e., device 122, formed of the extended coax cable from device 120, and spaced one-quarter wavelength from the resonant feed device attached to the antenna. The second device is resonant at the same resonant frequency as device 120. The extension of coax between the devices 120, 122 is totally current and voltage free, i.e., a free metal length which can assume whatever potential is radiated from the antenna, without deteriorating the antenna radiation pattern, thereby optimizing the electrical ground independence of the antenna array at the resonant frequency.

Figure 13:
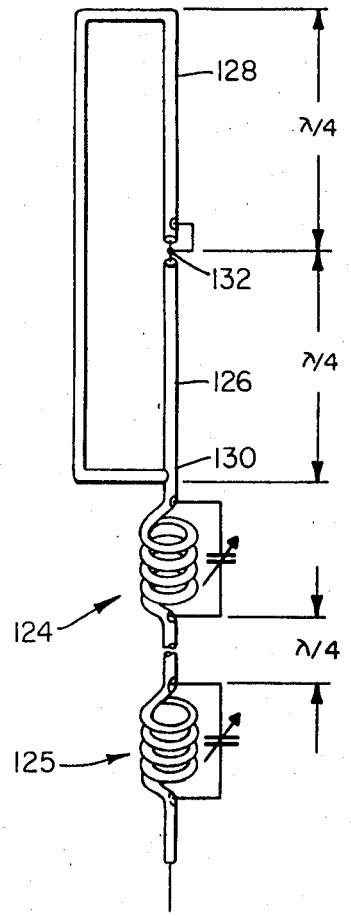
FIG. 13 is a simplified view of a vertical dipole antenna array with the resonant feed device in accordance with the invention.

FIG. 13 depicts still another embodiment of the invention, employing a folded dipole antenna array. A resonant feed device 124 is formed at the end of the array forming a lower radiator 126 of length $\lambda/4$. The center wire of the coax is coupled to the outer shield of a similar coax, or to a metal tubing, etc., (herein numbered 128) which is folded over a length $\lambda/4$ in conventional folded dipole configuration. The end of the folded (upper) radiator is soldered to the outer shield of the lower radiator 126 at a base 130 of the vertical folded dipole antenna array. The diameters of the material forming the folded dipole should be matched to provide similar impedance characteristics.

The folded dipole configuration may be physically shortened by adding loading coils, in the manner previously described, somewhere along the radiators, preferably at the center 132 of the antenna. An additional resonant feed device 125 is coupled to the feed line as shown in previous FIG. 12. If the folded dipole antenna is located close to a conducting ground, then only one feed device is required as in FIG. 5A.

Likewise, when employing a folded dipole configuration, impedance matching may be effected along with physically shortening the antenna, by adding elements in parallel to the driven radiator, i.e., making a triple element, folded dipole. So with a folded dipole, as the length is decreased, the feed point impedance can be kept high by adding parallel radiator elements to the driven element. Loading coils are inserted as per usual when shortening a dipole antenna. In addition, a transformer may be employed at the center 132 of the antenna to provide impedance matching in conventional manner. In a folded dipole, the transformer can be built into the antenna array.

Thus, the invention combination allows the end feeding of a folded dipole, which heretofore has been impractical. In fact, all the antennas of previous description are electrically center fed, but physically end fed, a highly desirable advantage.

The folded dipole of FIG. 13 may be made of a piece of 300 ohm ribbon, of 72 ohm coaxial cable, of a piece of tubing coupled to the lower radiator 126, etc.

FIG. 14 shows the resonant feed device being used to perform the unbalanced-to-balanced transformation that is requird when one center feeds a dipole antenna with a coaxial cable feed line. If coaxial cable is connected directly to the center feed points of a dipole antenna, the antenna currents that flow in the dipole half which is connected to the shield of the coaxial cable will continue to flow down the outside of the feed line, which will then radiate. This radiation will interact with the dipole radiation and will drastically alter the radiation characteristics of the antenna. Since the feed device is being connected at a voltage node, or current maximum point on the antenna, only one resonant feed device is required. Since the very high, near infinite, impedance of the resonant circuit connected on the outside of the shield of the coaxial cable feed line prevents any current flow down the outside of the coaxial cable, the currents at the end of the coaxial cable are restricted to those that flow inside the cable, which are equal and opposite, or balanced. The resonant feed device, therefore, allows the transformation from an unbalanced coaxial line to a balanced antenna feed by not allowing the unbalanced current to flow on the outside of the coaxial cable where it joins the dipole antenna.

I claim:

1. A feed device for coupling feed line means to a narrow band antenna of specific resonant frequency and well defined electrical current and voltage node points, wherein the antenna currents at the electrical end points of the antenna are zero, wherein the antenna and the feed line are formed of coaxial cable, comprising the combination of;

resonant circuit means formed from the antenna feed line and having an infinite impedance at a well defined current node point and resonant at a specific resonant frequency identical with the same specific antenna resonant frequency before and after being coupled to the antenna;

wherein the resonant circuit means includes inductor means formed from an extension of the coaxial cable, and capacitor means coupled in shunt across the inductor means and directly to the shield of the coaxial cable, with the common junction therebetween nearest the antenna defining a current node point of infinite impedance which is coupled to the current node point of the antenna;

a feed line connection coupled to the resonant circuit means and having substantially zero antenna current thereon due to the common coupling of the respective current node points, to thus preclude altering the electrical and radiation characteristics of the antenna by the presence of the feed line; and wherein the antenna further includes matching pairs of traps selectively disposed in electrical series along the length thereof to provide a multiple-band antenna array which is resonant at selected multiple frequencies, said resonant circuit means being formed at the feed end of the antenna and disposed to resonate at the lowest frequency of the selected multiple frequencies to isolate the antenna from the feed line.

2. A feed device for coupling feed line means to a narrow band antenna of specific resonant frequency and well defined electrical current and voltage node points, wherein the antenna currents at the electrical end points of the antenna are zero, wherein the antenna and the feed line means are formed of coaxial cable and the antenna is located away from a conductive ground plane, the feed device comprising the combination of;

first resonant circuit means including inductor means, and capacitor means coupled in shunt across the inductor means, with the common junction therebetween nearest the antenna having an infinite impedance at a well defined current node point, the resonant circuit means being resonant at a specific resonant frequency identical with the specific antenna resonant frequency before and after being coupled to the antenna;

said first resonant circuit means being coupled at its well defined current node point to the well defined antenna current node point;

second resonant circuit means similar to the first resonant circuit means and coupled in electrical series therewith at an electrical spacing of one-quarter wavelength of the common resonant frequency; and a feed line connection coupled to the second resonant circuit means and having substantially zero antenna current thereon due to the common coupling of the respective current node points of the antenna and the first resonant circuit means in combination with the second resonant circuit means, to thus preclude alteration of the electrical and radiation characteristics of the antenna by the presence of the feed line.

* * * * *